US010565824B2

(12) United States Patent
Czyzewski

(10) Patent No.: US 10,565,824 B2
(45) **Date of Patent: *Feb. 18, 2020**

(54) JACKPOT GAMING METHOD AND SYSTEM FOR GAME EVENTS WITH VARYING EVENTS PROBABILITIES

(71) Applicant: Zbigniew Czyzewski, Henderson, NV (US)

(72) Inventor: Zbigniew Czyzewski, Henderson, NV (US)

( * ) Notice: Subject to any disclaimer, the term of this patent is extended or adjusted under 35 U.S.C. 154(b) by 66 days.

This patent is subject to a terminal disclaimer.

(21) Appl. No.: 15/894,925

(22) Filed: Feb. 12, 2018

(65) Prior Publication Data

US 2019/0057577 A1 Feb. 21, 2019

Related U.S. Application Data

(63) Continuation of application No. 14/789,938, filed on Jul. 1, 2015, now Pat. No. 9,911,277.

(60) Provisional application No. 62/097,128, filed on Dec. 29, 2014.

(51) Int. Cl.
*A63F 9/00* (2006.01)
*G07F 17/32* (2006.01)

(52) U.S. Cl.
CPC ..... *G07F 17/3258* (2013.01); *G07F 17/3272* (2013.01)

(58) Field of Classification Search
None
See application file for complete search history.

(56) References Cited

U.S. PATENT DOCUMENTS

2003/0013510 A1* 1/2003 Vuong ..... G07F 17/32 463/13
2004/0038735 A1* 2/2004 Steil ..... G07F 17/32 463/27
2004/0166940 A1* 8/2004 Rothschild ..... G07F 17/32 463/42
2005/0037837 A1* 2/2005 Rowe ..... G06Q 30/0209 463/25
2005/0059467 A1* 3/2005 Saffari ..... G07F 17/32 463/19
2007/0167226 A1* 7/2007 Kelly ..... G07F 17/32 463/29
2008/0207312 A1* 8/2008 Seelig ..... G07F 17/323 463/26

(Continued)

*Primary Examiner* — Seng Heng Lim
(74) *Attorney, Agent, or Firm* — Newman Law, LLC

(57) ABSTRACT

Systems, apparatuses, and methods are presented for operating a generalized progressive gaming system which offers a common progressive jackpot for a various games with different sets of winning hands and different denominations. The generalized progressive system represents a jackpot in terms of probability and adds a normalizing random event to a player's bet and the hand player receives. In order to win a jackpot the player must receive a qualified hand and a combined probability of these two events, namely a hand and a normalizing random event, must be smaller than a required value. Any qualified hand can win the jackpot. Handling of various denominations is proposed. Generalized progressive system apparatus is also provided that includes a display, a user interface, a processor and a server.

20 Claims, 2 Drawing Sheets

(56) References Cited

U.S. PATENT DOCUMENTS

| | | | | |
|---|---|---|---|---|
| 2009/0075714 | A1* | 3/2009 | Meyer | G07F 17/32 463/19 |
| 2009/0104987 | A1* | 4/2009 | Kelly | G07F 17/3267 463/29 |
| 2009/0131175 | A1* | 5/2009 | Kelly | G07F 17/3267 463/42 |
| 2009/0264171 | A1* | 10/2009 | Acres | G07F 17/3258 463/7 |
| 2010/0081497 | A1* | 4/2010 | Wolf | G07F 17/32 463/25 |
| 2015/0080117 | A1* | 3/2015 | Czyzewski | G07F 17/34 463/27 |

* cited by examiner

JACKPOT GAMING METHOD AND SYSTEM FOR GAME EVENTS WITH VARYING EVENTS PROBABILITIES

CROSS REFERENCE TO RELATED APPLICATION(S)

This application claims the benefit of U.S. Non Provisional patent application Ser. No. 14/789,938 which was filed Jul. 1, 2015, now granted as U.S. Pat. No. 9,911,277, and U.S. Provisional Patent Application No. 62/097,128 which was filed Dec. 29, 2014, the disclosures of which are incorporated herein by reference.

BACKGROUND OF THE INVENTION

The present invention involves live table games where players make one or more wagers on the outcome of the game played according to specific set of rules for a specific game. A progressive jackpot system and apparatus are proposed which could be common for various table games with different wager denominations and hit frequencies.

This invention relates to gaming systems and, in particular, to progressive jackpot systems for table games. The approach presented can be used for electronic game machines playing especially live table games, as well.

In a table game, especially a card table game, players and/or a dealer get a set of cards and players try to assemble a winning hand according to the rules of a game. In addition to wagering on a base game, players can wager on any side bets, if exist, which enhance the base game appeal to the players by providing more wagering options.

One of the side bets is a progressive jackpot side bet, where the main prize is a common jackpot for many tables playing, usually the same game type. Portion of a player progressive side bet goes into a progressive jackpot which increases over time to a significant amount before somebody wins it. Normally the progressive wager is fixed for all tables. The value of a wager does not have any effect on a chance of winning the jackpot.

Different table games define different winning hands for a progressive jackpot; therefore, the most common progressive system arrangement is to link all tables playing the same game to the game progressive jackpot. In a gaming establishment or casino there are often only several tables and therefore a common progressive jackpot for all different games would be very welcome by both players and casinos, since the jackpot value would grow faster and would attract players.

One possible type of solution proposed in U.S. Pat. No. 5,707,285 to Place et al and in U.S. Patent Publication No. 2014/0113712 to Van Asdale was to offer a progressive jackpot in an additional bonus round for a winning hand. These solutions, however, do not address the case of different progressive wager denomination and take significant time to operate and therefore are not popular in casinos.

The solution discussed in U.S. Pat. No. 4,837,728 to Barrie et al for electronic machines to equalize the contribution amount to jackpot from each gaming machine would be difficult to accept for players who play less popular games but would like to have the same chance of winning the jackpot as at other games.

SUMMARY OF THE INVENTION

The present invention presents a generalized method of progressive gaming system which offers a common progressive jackpot for a various games with different sets of winning hands and different denominations.

Embodiments of this invention are directed to systems and methods for operating the progressive or bonusing system with practically unlimited range of gaming tables connected to the progressive or bonusing link.

One of the core concepts of the generalized progressive system of some embodiments is a representation of a jackpot in terms of probability or in broader sense, a jackpot score value and an addition of a normalizing random event to a player's bet and the hand player receives. In order to win a jackpot the player must receive a qualified hand and a combined probability of these two events, namely a hand and a normalizing random event, must be equal or smaller than a required jackpot score value. In most progressive systems the probability of winning a jackpot, $P_{Jack}$, is equal to the probability of receiving the winning hand, or in general terms, the probability of a preset game event $P_{PGE}$ $P_{Jack}=P_{PGE}$.

The aforementioned normalizing random event could be as simple as a generation of a random number in the range of 0 to 1, which would represent the probability of the random event to generate a number, $P_{RE}$, in the range of 0 to 1, which would be smaller or equal to $P_{RE}$. In some embodiments, the random event could be another gaming random event provided that its probability would be as much uniform as possible.

In the generalized progressive system the jackpot can be won with the combined events when the combined probability or jackpot game score, $P_{JGS}$, is smaller than the set value for jackpot $P_{Jack}$, that is, $P_{Jack}>=P_{JGS}$ $P_{PGE}$ $P_{RE}$; where: $P_{PGE}$ is a probability associated with a player hand.

Let's assume that a casino decided to have only two winning jackpot hands for the Caribbean Stud, namely Royal Flush and Straight Flush. The probability for Royal Flush is 8.408E-7. The probability for Straight Flush is 7.873E-6. If casino sets the jackpot winning probability to 9.000E-7, then Royal Flush hand wins the jackpot outright regardless of the outcome of the normalizing random event. The Straight Flush hand would need the random event with probability of 0.114 or smaller to win the jackpot. This arrangement would provide an opportunity for players with lower hands but still on the list of qualified hands to win the jackpot with the help of the random event. If casino would like to preserve the same advantage as it has right now, the jackpot probability might be set to lower value than the probability of Royal Flush.

The example above shows that hands with different probabilities within the same game can be awarded the jackpot win. Similarly, the hands from different games can participate in the same jackpot link since each hand can be characterized by its probability. Going even further this arrangement can apply to wide area progressive when different game tables from different casinos are connected to the same jackpot. The normalizing random event enables various hands to compete for the same jackpot as long as the overall winning probability is the same regardless what game the player plays. The above method could easily be extended to smaller jackpot levels, like 10% percent level with probability significantly higher than 100% jackpot. A hand with the associated random event could participate in any award but only wins one which fulfils the condition, $P_{Jack}>=P_{PGE}$ $P_{RE}$. In the case of different games, it is important to normalize the chances of jackpot win for each game. This could be achieved by allowing the same number of qualified hands or preset game events.

Handling various denominations in the jackpot probability model is possible, although the solution proposed for slots by Barrie cannot be applied to a hand-based jackpot system since players are aware of the winning hands. The Barrie's solution could apply, however, to mystery type jackpots.

The player who plays at the table with let's say double denomination or double jackpot contribution than usual and receives a qualifying hand can be viewed as playing one qualifying hand and one completely losing bet. The player's jackpot game score or combined probability could be represented as $P_{JGS}=P_{PGE}\ P_{LB}\ P_{RE}$; where: $P_{LB}$ represents the probability of a single losing bet.

In the Caribbean Stud considering the qualified hands as Two Pair or above, probability of losing hand would 0.98. This is not a significant decrease of the combined probability but it is fair considering the winning odds.

In a preferred embodiment the jackpot game score for a player's after receiving a hand is expressed as follows $P_{JGS}=P_{PGE}\ (P_{LB})^{N-1}\ P_{RE}$; where: N is the multiplier of a minimum wager. If a player plays minimum bet, N=1. The formula above can be rewritten in the final representation as $P_{JGS}=P_{PGE}\ P_{WC}\ P_{RE}$; $P_{WC}=(P_{LB})^{N-1}$; where: $P_{WC}$ is the probability of a credited event related to the higher wager value than minimum bet, shortly denomination factor or wager credit value. Keeping that terminology the other factors are qualifying hand factor or preset game event and random event factor, respectively.

A casino can provide other formula or a set of values for the denomination factor as long as they are approved by a jurisdictional authority. The denomination factor is normally defined for the entire table. In the case of different games with different probabilities $P_{LB}$ linked to the same progressive, the $P_{LB}$ for the entire link should be selected in a range between min and max values of $P_{LB}$ for games linked together. Preferably $P_{LB}$ should be as high as possible. There must be a single value of $P_{LB}$ for the entire link. Normally, the progressive link is characterized by a progressive link minimum wager which applies to all connected games. However, the casino management may require that for some games the minimum progressive wager may be higher than the minimum wager for the entire progressive link. In such cases the players wagering at tables with higher progressive minimum should receive a wager credit $P_{WC}$.

A system apparatus is provided that includes a minimal set of items required on the table side, namely a display, a table processor with an interface, possibly a card dealing device for a card game and a set of chip sensors which could be modified to enhance player experience. Functions of a server are presented as well. The table processor executes instructions that cause the processor to recognize betting and possibly hand events, receives the random event factors from a server for each position and calculates the player combined probabilities. In case of a player winning event, the processor notifies a dealer and sends notification to the server which verifies the table processor calculations.

Accordingly, the present invention provides enhancement solutions to the existing progressive and bonusing systems, apparatuses, and methods. Those of ordinary skill in the art will readily appreciate, therefore, that those and other details, features, and advantages of the present invention will become further apparent in the following detailed description of the preferred embodiments of the invention.

In some embodiments, the invention is directed to a progressive jackpot gaming system for providing a progressive jackpot award responsive to receiving a progressive jackpot wager in connection with the play of one or more wagering games, the system comprising: at least one data communication device; at least one processor; at least one random number generator configured to generate a random event value; and at least one memory device storing a plurality of instructions which, when executed by the at least one processor, cause the at least one processor to: determine a jackpot game score responsive to the occurrence of a preset game event; and communicate the awarding of a progressive jackpot responsive to the jackpot game score being the same or smaller than one or more preset progressive jackpot award score values, wherein the jackpot game score is determined by the application of a predefined relationship setting forth the jackpot game score based at least partially on the random event outcome value and a preset game event probability value associated with the probability of the preset game event occurring during an instance of the wagering game.

In some embodiments, the predefined relationship comprises: $P_{JGS}=P_{RE}\ P_{PGE}$, wherein $P_{JGS}$ is the jackpot game score, $P_{RE}$ is the random event outcome value and $P_{PGE}$ is the preset game event probability value.

In some embodiments, the predefined relationship sets forth the jackpot game score based at least partially on the random event outcome value, the preset game event probability value and the amount of the progressive jackpot wager value exceeding a minimum amount required for the progressive jackpot wager.

In some embodiments, the predefined relationship comprises: $P_{JGS}=P_{RE}\ P_{WC}\ P_{PGE}$, wherein $P_{JGS}$ is the jackpot game score, $P_{RE}$ is the random event outcome value, $P_{PGE}$ is the preset game event probability value, and $P_{WC}$ is the wager credit value, the wager credit value having the property of causing a small reduction of $P_{JGS}$ bringing it closer to be the same or smaller than the one or more preset progressive jackpot award values based on the extent the progressive jackpot wager value exceeds the minimum amount required for the progressive jackpot wager.

In some embodiments, $P_{WC}$ is equal to $(P_{LB})^{N-1}$, wherein $P_{LB}$ is the predefined probability of losing a wager placed in the wagering game in which the preset gaming event occurred, and N is the wager received expressed as a multiple of a minimum wager required for the progressive jackpot wager.

In some embodiments, the at least one processor actuates the random number generator to generate the normalizing random event value responsive to the communication of the initiation of a round of play of any of the one or more wagering games.

In some embodiments, a new normalizing event value is generated by the random number generator responsive to the start of the next round of play of any of the one or more wagering games. In some embodiments, a normalizing event value is generated for each player.

In some embodiments, the plurality of instructions which, when executed by the at least one processor, cause the at least one processor to discard the normalizing random event outcome value responsive to the failure of a preset game event to occur.

In some embodiments, the normalizing random event outcome value is operatively associated with a single wagering game of the one or more wagering games.

In some embodiments, the one or more preset progressive jackpot award values comprise a preset range of jackpot score values.

In some embodiments, the preset range of values includes values greater than zero and less than one.

In some embodiments, the one or more wagering games include one of the same and different wagering games, the same wagering games and different wagering games.

In some embodiments, the communication device comprises an input device connected with a gaming table.

In some embodiments, the system further comprises at least one display device configured to communicate the awarding of a progressive jackpot responsive to the jackpot game score being the same or smaller than one or more preset progressive jackpot award values.

The invention is also directed to a method of providing a progressive jackpot award responsive to play of one or more wagering games, including programming and a plurality of executable instruction stored in a memory device, comprising the steps of: actuating a random number generator to randomly generate an normalizing random event outcome value; responsive to receiving input through a data input device relating to the occurrence of a preset game event during play of the one or more of the wagering games, causing a processor to execute the plurality of instructions to determine the jackpot game event probability value by applying a predefined relationship setting forth the jackpot game score based at least partially on the normalizing random event outcome value and a preset game event probability value associated with the preset game event; and causing the processor to execute the plurality of instructions to communicate the awarding of the progressive jackpot award responsive to the jackpot game score being the same or smaller than one or more preset progressive jackpot award score values stored in memory.

In some embodiments, the predefined relationship comprises: $P_{JGS}=P_{RE}\ P_{PGE}$, wherein $P_{JGS}$ is the jackpot game score, $P_{RE}$ is the normalizing random event outcome value and $P_{PGE}$ is the preset game event probability value.

In some embodiments, the predefined relationship sets forth the jackpot game score based at least partially on the normalizing random event outcome value, the preset game event probability value and the amount of the progressive jackpot wager value exceeding a minimum amount required for the progressive jackpot wager.

In some embodiments, the predefined relationship comprises: $P_{JGS}=P_{RE}\ P_{WC}\ P_{PGE}$, wherein $P_{JGS}$ is the jackpot game score, $P_{RE}$ is the normalizing random event outcome value, $P_{PGE}$ is the preset game event probability value, and $P_{WC}$ is the wager credit value, the wager credit value having the property of causing a small reduction of $P_{JGS}$ bringing it closer to be the same or smaller than one or more preset progressive jackpot award values based on the extent the progressive jackpot wager value exceeds the minimum amount required for the progressive jackpot wager.

In some embodiments, $P_{WC}$ is equal to $(P_{LB})^{N-1}$ wherein $P_{LB}$ is the predetermined probability of losing a wager placed in the wagering game in which the preset gaming event occurred, and N is the wager received expressed as a multiple of a minimum wager required for the progressive jackpot wager. N is the multiple of a required minimum wager.

In some embodiments, the at least one processor actuates the random number generator to generate the normalizing random event outcome value responsive to the communication of the initiation of a round of play of any of the one or more wagering games.

The invention is also directed to a method of winning a jackpot in a progressive wagering system comprising the steps of: at least two gaming tables or machines playing the same or different games; a progressive jackpot shared by all gaming machines or tables, the progressive prize being characterized by a minimum jackpot probability $P_{Jack}$ required to win the prize; a set of qualifying hands to win the jackpot; each hand is characterized by its occurrence probability $P_{PGE}$; and a random event generator which generates normalizing random event having a probability $P_{RE}$, wherein a player receiving or betting on a hand with probability $P_{PGE}$ and probability $P_{RE}$ automatically wins the jackpot responsive to $P_{JGS}=P_{PGE}\ P_{RE}$ being equal to or smaller than probability of winning the jackpot $P_{Jack}$.

In some embodiments, the aforementioned method further comprises a uniform random number generator for generating a $P_{RE}$ in the range from greater than 0 to less than 1.

In some embodiments, the aforementioned method further comprises a set of jackpot awards each characterized by different probabilities. A player may win an award with the smallest probability for which combined bet probability is smaller or equal than jackpot probability.

In some embodiments, the aforementioned method further comprises a probability credit $P_{WC}$ in case of player bet exceeding the minimum required progressive bet for the entire system. The denomination credit $P_{WC}=(P_{LB})^{N-1}$ and combined bet probability in this case is $P_{JGS}=P_{PGE}\ P_{WC}\ P_{RE}$, wherein $P_{LB}$ is the probability of a losing hand and N is the multiplier of a minimum wager.

The invention is also directed to a progressive wagering system for table games, comprising: at least two gaming tables playing the same or different games; a wager sensor for each table regardless of whether fixed or variable wagering is used at the table a progressive prize which could be won by any player; the prize being described by a minimum jackpot probability required to win the prize; a set of qualifying hands to win the jackpot; a table controller with a processor and memory coupled to at least the user interface and the wager detection means; the processor executing instructions which cause the processor to: communicate coin-in information to the central progressive controller; receive or generate the random normalizing event for each bet after a game round starts; receive an input about players' qualifying hands from either card dealing device or other sensor or inputted by a dealer; calculate the combined probability of a player's bet including the lowering of hand probability if player wager was higher than minimum value required to play the progressive; and award the jackpot prize to a player whose combined bet probability is equal or smaller than the jackpot probability.

The aforementioned systems may be electronic gaming machines, mobile computing devices, smart phones, terminals or electronic platforms including multiple data input devices providing player positions.

BRIEF DESCRIPTION OF THE DRAWINGS

The accompanying drawings, which are incorporated herein and constitute part of this specification, include one or more embodiments of the invention, and together with a general description given above and a detailed description given below, serve to disclose principles of embodiments of a generalized progressive system for table games.

DETAILED DESCRIPTION OF THE INVENTION

Reference will now be made to embodiments of apparatuses, systems, and methods for wagering on the generalized progressive system for table games, examples of which are illustrated in the accompanying drawings. Details, features, and advantages of the generalized progressive system for table games will become further apparent in the following detailed description of embodiments thereof.

Systems, apparatuses, and methods to perform the generalized progressive system for table games are described herein. Any reference in the specification to "one embodiment," "a certain embodiment," or any other reference to an embodiment is intended to indicate that a particular feature, structure or characteristic described in connection with the embodiment is included in at least one embodiment and may be utilized in other embodiments as well.

The functionality and principles of the embodiments disclosed herein may be implemented by or with software programs, executable instructions and applications and random number generators, operating in connection with computer hardware, such as data input/output or communication devices, data processing devices, display devices and data storage devices, which may be within the same housing or independent and connected remotely. It is expected that one of ordinary skill, notwithstanding the many design choices motivated by, for example, available time, current technology, and economic considerations, when guided by the concepts and principles disclosed herein will be readily capable of generating such software and executable instructions, including instructions regarding the collection of game play data relating to the progressive jackpot wagers placed and occurrence of game events, and selecting appropriate hardware with minimal experimentation. Therefore, in the interest of brevity and minimization of any risk of obscuring the principles and concepts according to this embodiment of the invention, further discussion of such software and hardware, if any, will be limited to the essentials with respect to the principles and concepts used by the preferred or exemplary embodiments.

The generalized progressive system for table games can be used in various environments. In brick-and-mortar casinos it can be added to a standard table games to enhance the wagering options and attract more players. It may also be used with any variation of electronic table game, or slot machine playing a table game with real or electronic dealer. The generalized progressive system for table games can be utilized in a virtual environment as well, where a game is simulated by a computer. In any of these environments the winning hand is always a result of a random event, in which a player hand or set of tokens is selected from a set of all possible outcomes.

Figure 1:
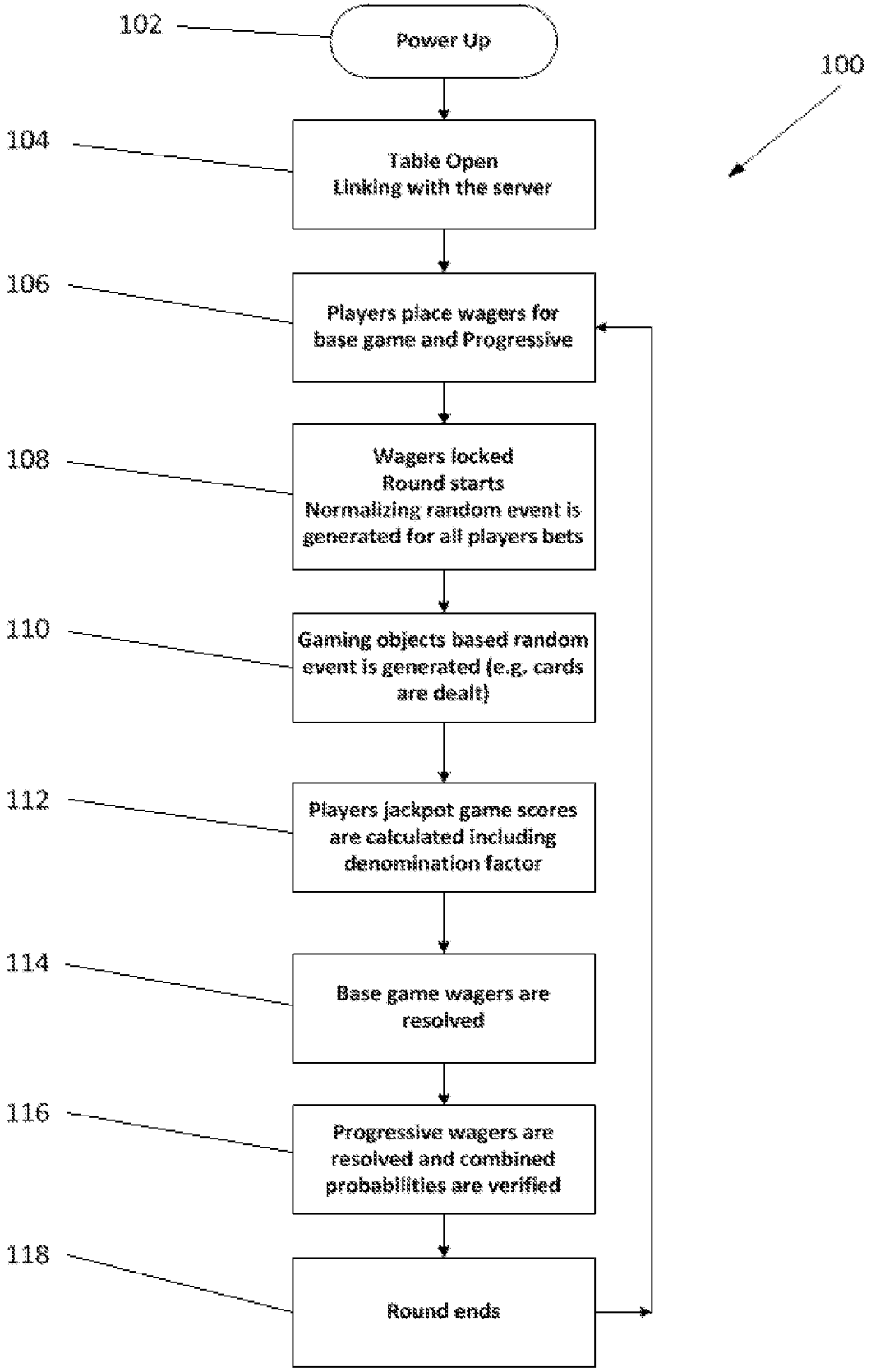
FIG. 1 illustrates an embodiment of a generalized progressive system for table games.

FIG. 1 illustrates an embodiment of a generalized progressive system for table games 100. It represents a table operation flowchart for a generalized progressive system for table games.

After a table system power up 102, a table is opened by a dealer and a communication with progressive server is established during phase 104. Gaming operation starts with a betting phase 106, which provides an opportunity for players to place wagers for base game and a progressive jackpot.

In the next phase 108, wagers are locked by a dealer and round starts. In the preferred embodiment the normalizing random event for every player bet is generated in this phase. The event can generated at the server and generated probabilities $P_{RE}$ are sent to a table in the response to a round start message from a table. The event could be generated at a table, but the $P_{RE}$ data would have to be sent to a server for logging and farther operations. Event generation at the server provides much better security and, if necessary in the case of subsequent jackpot, operation reproducibility. The event generation can be performed in the later phase after the gaming token operation is performed (e.g. card dealing). The advantages of conducting the normalizing random event at the beginning of the round are two-fold. In the case of communication interruption with the server after the round start, the table controller can perform all operations and resolve all wagers if there are no jurisdictional restrictions. The other benefit of knowing the result of the normalizing event is that the system knows what hand a player needs to receive in order to win the jackpot. This is important, especially in games when a player decides on a game play. In the other embodiment, some casinos may provide this information to players to enhance the game experience. The information could be displayed on a display or provided through additional color and flashing pattern of the player betting sensor.

The next phase, 110, is the actual game play. Every player or a position a player bets on, receives a set of game tokens called a hand. Every hand is characterized by a probability $P_{PGE}$ of receiving it. In a live table game this phase involves gaming tokens like playing cards or dice. In the electronic or virtual environment this phase is simulated by a computer system. Phases 108 and 110 can be performed simultaneously.

In the next phase 112, players' jackpot game scores are calculated using following formula $P_{JGS}=P_{PGE}\ P_{WC}\ P_{RE}$; $P_{WC}=(P_{LB})^{N-1}$ where all factors were explained previously. In a table game without electronic card reading devices or other sensors, dealer must input a hand type through a dealer interface or a keypad. This could be a simple two-stroke operation. Dealer provides this information only for any eligible winning hand and when progressive bet was placed. Wager denomination needs to be inputted to the system electronically without dealer intervention or a fix denomination should be assumed for the entire table. The bet probabilities could be calculated by a table controller and winning bets calculations should be verified by a server before they are presented.

The next two phases, 114 and 116, are the payout phases for base game wagers and progressive wagers, respectively. A progressive bet wins if its associated jackpot game score is equal or lower than a jackpot probability $P_{Jac}$. In many cases there might be a few jackpot levels and/or tiers and associated jackpot probabilities.

After payout phase a round ends and the next round betting phase starts.

Figure 2:
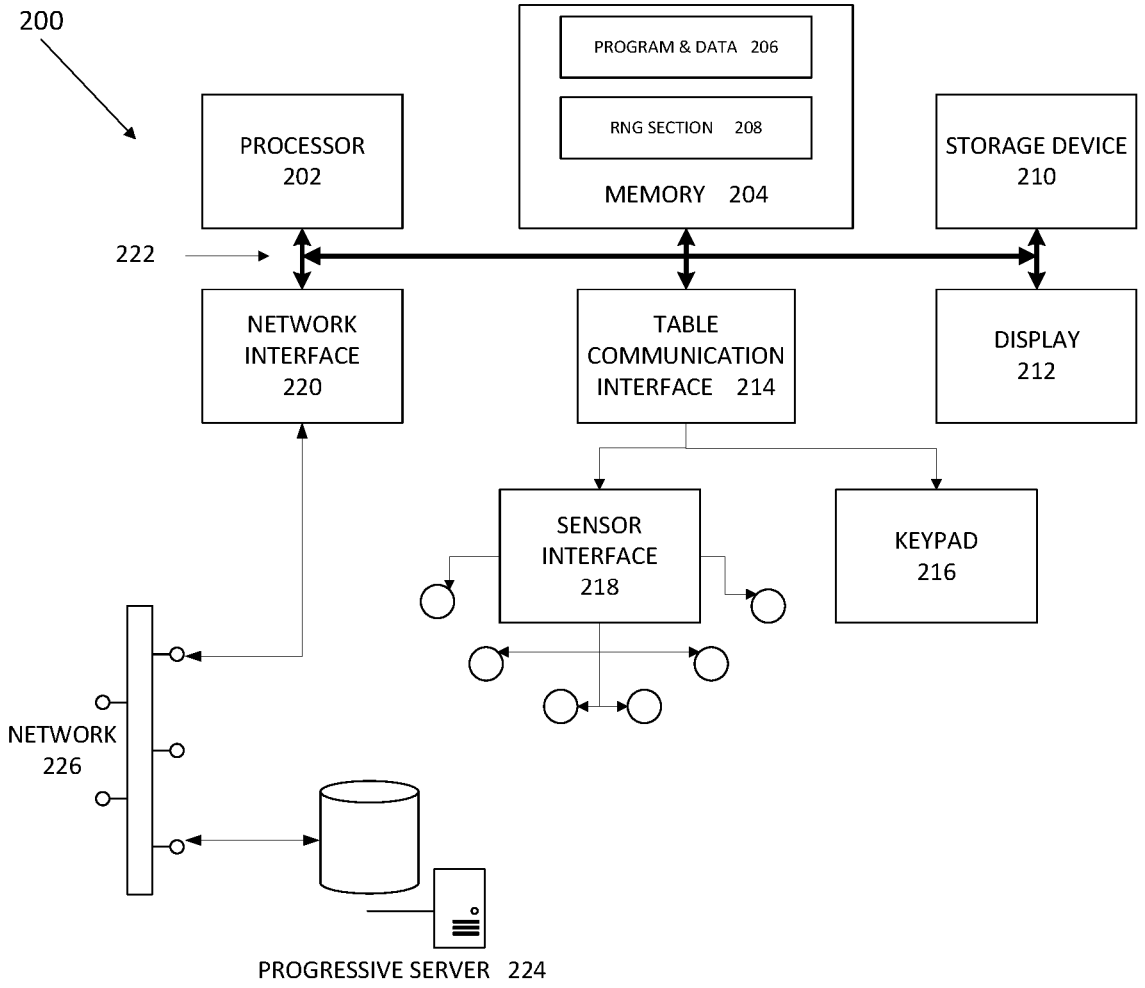
FIG. 2 illustrates an embodiment of an implementation of a generalized progressive system for table games.

The generalized progressive system for table games like every progressive system needs a computer system which runs the required software and interacts with peripheral devices. FIG. 2 illustrates an embodiment of the computer system 200 for a generalized progressive system for table games, which includes a table controller consisting of a processor 202, memory 204, a storage device 210, a table display 212, network interface 220, and one or more communication interfaces 214. Bet sensors connect to the table system through a sensor interface 218. A dealer interacts with the table system using a keypad 216. The generalized progressive system for table games 200 contains furthermore a remote progressive server 224 connected with many table systems via network 226.

Communication between the memory 204, the processor 202, the storage device 210, the display 212, the network interface 220, and the communication interface 214 may be performed by way of one or more communication busses 222. Those busses 222 may include, for example, a system bus, a peripheral component interface bus, and an industry standard architecture bus.

The memory 204 may include any memory device including, for example, random access memory (RAM), dynamic RAM, and/or read only memory (ROM) (e.g., programmable ROM, erasable programmable ROM, or electronically erasable programmable ROM) and may store computer program instructions and information. The memory may furthermore be partitioned into sections including program and data partition 206 in which instructions for carrying out the progressive system services are stored. The program and data partition may store program instructions that are executed by the processor 202. The RNG partition 208 may furthermore store computer program instructions to execute the random number generator to generate normalizing random event locally at the table if chosen by the operator.

It should be recognized that any or all of the components 202-220 may be implemented in a single machine.

Those skilled in the art will readily appreciate that the methods described herein may be incorporated in systems such as those discussed above that may include various computer and network related software and hardware, such as programs, operating systems, memory storage devices, data input/output devices, data processors, servers with links to data communication systems, wireless or otherwise, and data transceiving terminals, and may be a standalone device or incorporated in another platform, such as a mobile device. The systems and methods of the invention may be provided on partially or fully electronic platforms with multiple player positions. In addition, the systems and methods of the invention may be provided at least in part on a personal computing device, such as home computer, laptop or mobile computing device through an online communication connection or connection with the Internet. Those skilled in the art will further appreciate that the precise types of software and hardware used are not vital to the full implementation of the systems and methods of the invention so long as players and operators thereof are provided with useful access thereto.

The order of execution or performance of the operations in the embodiments of the invention illustrated and described herein is not essential, unless otherwise specified. Thus, the operations described herein may be performed in any order, unless otherwise specified, and embodiments of the invention may include additional or fewer operations than those disclosed herein. For example, it is contemplated that executing or performing a particular operation before, contemporaneously with, or after another operation, is within the scope of aspects of the invention.

While the present invention has been disclosed with reference to certain embodiments, numerous modifications, alterations, and changes to the described embodiments are possible without departing from the scope of the present invention, as defined in the appended claims. Accordingly, it is intended that the present invention not be limited to the described embodiments, but that it have the full scope defined by the language of the following claims, and equivalents thereof.

What is claimed is:

1. A progressive jackpot gaming system for providing a progressive jackpot award responsive to receiving a progressive jackpot wager in connection with the play of one or more wagering games of any kind, the system comprising:

a wagering game controller configured to communicate an occurrence of one or more preset game events during an instance of play of at least one wagering game of the one or more wagering games;

a progressive jackpot server in communication with the wagering game controller;

at least one processor in communication with the wagering game controller and the progressive jackpot server;

at least one random event outcome generator configured to generate a random event outcome value; and at least one memory device storing a preset progressive jackpot award score value, a preset game event probability value, the preset game event probability value being associated with the probability of the occurrence of each preset game event of a plurality of preset game events, and a plurality of instructions which, when executed by the at least one processor, cause the at least one processor to:

a) determine a jackpot game score responsive to receiving from the wagering game controller a communication of the occurrence of a specific preset game event of the plurality of preset game events stored in memory; and thereafter to b) direct the progressive jackpot server to communicate the awarding of a progressive jackpot to the wagering game controller responsive to the jackpot game score being equal to or less than the preset progressive jackpot award score value stored in memory in association with the specific preset game event, wherein the jackpot game score is determined by the application of a predefined relationship setting forth the jackpot game score based at least partially on the random event outcome value generated by the random event outcome generator and the preset game event probability value stored in memory in association with the specific preset game event.

2. The progressive jackpot gaming system according to claim 1, wherein the predefined relationship comprises: $P_{JGS}=P_{RE}\,P_{PGE}$, wherein $P_{JGS}$ is the jackpot game score, $P_{RE}$ is the random event outcome value and $P_{PGE}$ is the preset game event probability value.

3. The progressive jackpot gaming system according to claim 2, wherein the predefined relationship sets forth the jackpot game score based at least partially on the random event outcome value, the preset game event probability value and the amount of the progressive jackpot wager value exceeding a minimum amount required for the progressive jackpot wager.

4. The progressive jackpot gaming system according to claim 3, wherein the predefined relationship comprises: $P_{JGS}=P_{RE}\,P_{WC}\,P_{PGE}$, wherein $P_{JGS}$ is the jackpot game score, $P_{RE}$ is the random event outcome value, $P_{PGE}$ is the preset game event probability value, and $P_{WC}$ is the wager credit value, the wager credit value having the property of causing a reduction of $P_{JGS}$ based proportionally on the extent to which the progressive jackpot wager value exceeds the minimum amount required for the progressive jackpot wager.

5. The progressive jackpot gaming system according to claim 4, wherein $P_{WC}$ is equal to $(P_{LB})^{N-1}$, wherein $P_{LB}$ is the predefined probability of losing a wager placed in the wagering game in which the preset gaming event occurred, and N is the wager received expressed as a multiple of a minimum wager required for the progressive jackpot wager.

6. The progressive jackpot gaming system according to claim 1, wherein the at least one processor actuates the random event outcome generator to generate the random event outcome value responsive to the communication of the initiation of an instance of play of any of the one or more wagering games.

7. The progressive jackpot gaming system according to claim 6, wherein the random event outcome value is generated for each player in an instance of play of the wagering game as communicated by the wagering game controller.

8. The progressive jackpot gaming system according to claim 1, wherein the random event outcome value is operatively associated with a single wagering game of the one or more wagering games.

9. The progressive jackpot gaming system according to claim 1, wherein the preset progressive jackpot award values for the plurality of preset game events comprise a range of values.

10. The progressive jackpot gaming system according to claim 9, wherein the range of values includes values greater than zero and less than one.

11. The progressive jackpot gaming system according to claim 1, wherein the one or more wagering games include one of the same and different wagering games accessible on electronic gaming machines and gaming tables, the same wagering games accessible on electronic gaming machines and gaming tables, and different wagering games accessible on electronic gaming machines and gaming tables.

12. The progressive jackpot gaming system according to claim 1, wherein the processor is caused to determine a jackpot game score responsive to receiving from the wagering game controller a communication of the occurrence of a specific preset game event of the plurality of preset game events stored in memory and a communication indicating receipt of a progressive wager.

13. The progressive jackpot gaming system according to claim 1, further comprising at least one display device configured to communicate with the processor to display the awarding of a progressive jackpot responsive to the processor determining that the jackpot game score is equal to or less than the preset jackpot award score value.

14. A method of providing a progressive jackpot award including a processor in communication with a random number generator and a memory device, the memory device having both a preset progressive jackpot award score value and a preset game event probability value associated with the probability of the occurrence of each preset game event of a plurality of preset game events, programming and a plurality of executable instruction stored therein, the method comprising the steps of:

a) actuating the random number generator to randomly generate a normalizing random event outcome value;

b) responsive to the occurrence of a specific preset game event of the plurality of preset game events stored in memory during play of the one or more of the wagering games, causing the processor to execute the plurality of instructions to determine the jackpot game event probability value by applying a predefined relationship setting forth the jackpot game score based at least partially on the normalizing random event outcome value and the preset game event probability value stored in the memory as being associated with the specific preset game event; and c) causing the processor to execute the plurality of instructions to communicate the awarding of the progressive jackpot award responsive to the jackpot game score being equal to or less than the preset progressive jackpot award score value stored in the memory that is associated with the specific preset game event.

15. The method according to claim 14, wherein the predefined relationship comprises: $P_{JGS}=P_{RE}\,P_{PGE}$, wherein $P_{JGS}$ is the jackpot game score, $P_{RE}$ is the normalizing random event outcome value and $P_{PGE}$ is the preset game event probability value.

16. The method according to claim 15, wherein the predefined relationship sets forth the jackpot game score based at least partially on the normalizing random event outcome value, the preset game event probability value and the amount of the progressive jackpot wager value exceeding a minimum amount required for the progressive jackpot wager.

17. The method according to claim 16, wherein the predefined relationship comprises: $P_{JGS}=P_{RE}\,P_{WC}\,P_{PGE}$, wherein $P_{JGS}$ is the jackpot game score, $P_{RE}$ is the normalizing random event outcome value, $P_{PGE}$ is the preset game event probability value, and $P_{WC}$ is the wager credit value, the wager credit value having the property of causing a small reduction of $P_{JGS}$ bringing it closer to be the same or smaller than one or more preset progressive jackpot award values based on the extent the progressive jackpot wager value exceeds the minimum amount required for the progressive jackpot wager.

18. The method according to claim 17, wherein $P_{WC}$ is equal to $(P_{LB})^{N-1}$, wherein $P_{LB}$ is the predetermined probability of losing a wager placed in the wagering game in which the preset gaming event occurred, and N is the wager received expressed as a multiple of a minimum wager required for the progressive jackpot wager.

19. The progressive jackpot gaming system according to claim 14, wherein the at least one processor actuates the random number generator to generate the normalizing random event outcome value responsive to the communication of the initiation of a round of play of any of the one or more wagering games.

20. A progressive wagering system for wagering games, comprising:

a) one or more wagering games;

b) one or more input devices in communication with each of the at least two wagering games configured to detect a wager;

c) memory for storing a minimum jackpot probability required to win the prize and a set of hands in the game which qualify to win a progressive jackpot;

d) one or more communication devices configured to communicate game event information during game play of the one or more wagering games;

e) a processor and memory coupled to the one or more communication devices and the one or more input devices, the processor executing instructions which cause the processor to: generate using a random number generator a random normalizing event after a wagering game of the one or more wagering games is played; receive game event information from the one or more communication devices; calculate the combined probability of the wager including using the random normalizing event to reduce the qualified hand probability if the wager was higher than a minimum value required to play the progressive; and award the jackpot prize to a player whose qualified hand probability is equal or smaller than the minimum jackpot probability.

* * * * *